US008246392B2

(12) United States Patent
Amidon

(10) Patent No.: US 8,246,392 B2
(45) Date of Patent: Aug. 21, 2012

(54) SECURABLE CONNECTOR

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 409 days.

(21) Appl. No.: 12/556,194

(22) Filed: Sep. 9, 2009

(65) Prior Publication Data

US 2011/0059650 A1 Mar. 10, 2011

(51) Int. Cl.
*H01R 11/22* (2006.01)

(52) U.S. Cl. ..... 439/851; 439/842

(58) Field of Classification Search ..... 439/584, 439/578, 583, 851, 842, 843
See application file for complete search history.

(56) References Cited

U.S. PATENT DOCUMENTS

| | | | | |
|---|---|---|---|---|
| 5,226,841 | A | 7/1993 | Thorner | |
| 5,284,449 | A | 2/1994 | Vaccaro | |
| 5,318,458 | A * | 6/1994 | Thorner | 439/427 |
| 7,476,119 | B2 * | 1/2009 | D'Addario et al. | 439/427 |
| 2007/0238360 | A1 | 10/2007 | Khemakhem et al. | |

FOREIGN PATENT DOCUMENTS

| | | | |
|---|---|---|---|
| EP | 0124300 | A2 | 11/1984 |
| EP | 1655809 | A1 | 5/2006 |

OTHER PUBLICATIONS

PCT/US2010/047995 International Application filed Sep. 7, 2010. International Search Report and Written Opinion Date of Mailing Mar. 29, 2011. 9 pp.

* cited by examiner

*Primary Examiner* — Tulsidas C Patel
*Assistant Examiner* — Travis Chambers
(74) *Attorney, Agent, or Firm* — Schmeiser, Olson & Watts, LLP

(57) ABSTRACT

An electrical cable connector comprising an electrically conductive central body, an outer sleeve rotatably coupled to the central body, and a tubular cam member disposed between the outer sleeve and the central body. When the outer sleeve is rotated around the central body from a first rotational position to a second rotational position, the tubular cam member is displaced from a first axial position to a second axial position, thereby causing a radial camming region in an axial through bore of the tubular cam member to displace fingers of the electrically conductive central body radially inwardly. In that manner, when the connector is plugged into a port or jack comprising a cylindrical body that is at least partially enclosed by the fingers of the central body of the connector, the fingers clamp onto the body of the port, thereby securing the connector to the port.

27 Claims, 6 Drawing Sheets

SECURABLE CONNECTOR

BACKGROUND OF THE INVENTION

1. Field of the Invention

The present invention relates generally to a cable connector for connecting an electrical signal cable to an electrical signal port. More particularly, the present invention relates in one embodiment to a "cinch" or gripping-type cable connector which plugs into a signal port in a manner such that the connector is very secure, but easily unplugged.

2. Description of Related Art

A "cinch" or gripping connector, also referred to as an "RCA connector" or a "phono connector," is a type of electrical connector that is commonly used in the transmission of audio and/or video signals. In use, the connector is connected or "plugged into" a corresponding port that is often referred to as an "RCA jack" or port. The end of the connector opposite to the jack is connected to an electrical signal cable.

Some types of electrical signal ports, such as RF ports, are comprised of a cylindrical body which protrudes from a signal receiving and/or transmitting device, and which has threads on the cylindrical outer wall of the body. The corresponding connector to be fitted to such a port includes a nut which can be threaded onto the port to secure the connector to the port. While such an arrangement provides a highly secure connection with low signal loss, it is not satisfactory when there is a need to quickly connect or disconnect the cable from the device, or when the cable needs to be repeatedly connected to and disconnected from the device.

In such circumstances, an RCA port and RCA connector may be used to enable simple and quick connections and disconnections of the cable to the device. The RCA connector is comprised of an electrically conductive central pin or male connector surrounded by an electrically conductive ring. The pin and ring are insulated from each other. The pin is connected to an electrical signal conductor contained within the signal cable that is connected at the opposite end of the connector. In a typical coaxial cable, such as 75 ohm RF cable, the central conductor of the cable may extend directly into the conductive central pin. The ring of the connector is connected to the outer shielding of the cable.

The RCA port or jack is comprised of the aforementioned cylindrical body with a central hole. The exterior of the cylindrical body is comprised of a conductive sleeve that is typically connected to a ground. The central hole has a conductor contained therein, which is separated from the outer conductive sleeve by a suitable insulator, such as plastic or ceramic. When the connector and the port are connected to each other, the central pin of the connector is received in the central hole of the port, and an electrical connection is made between the central pin and the conductor within the central hole. In addition to providing an electrical connection, the engagement of the central pin with the hole serves, to some extent, to mechanically join the connector to the port by friction between them.

However, the main mechanical connecting force between the RCA connector and the port is provided by the engagement of the outer ring of the connector with the outer sleeve of the port. Typically, the sleeve of the port is slightly smaller in diameter and longer than the ring on the connector, such that the ring of the connector may fit over the sleeve of the port. The ring of the connector may be segmented into fingers, and sized such that an interference fit occurs between the connector ring and port sleeve, with the fingers of the connector ring bending radially outwardly when the connector is fitted to the port. The ring of the connector is dimensioned and configured so as to provide a gripping action onto the outer sleeve of the port.

This connection between the RCA connector and the port is often not sufficient to provide a reliable connection with good signal transmission through the connector and port. The sizes of RCA ports may vary, such that the ring of the connector may not have a snug fit with a particular port. Additionally, the fingers of the connector may become fatigued and/or bent with repeated connection and disconnection, such that they no longer provide sufficient clamping force on the sleeve of the port to maintain the connection and/or provide sufficient grounding continuity between the connector and the port.

What is needed is an RCA or gripping connector that can be quickly connected to and disconnected from a corresponding port, while having a strong mechanical engagement with the port and reliable electrical continuity through the port when connected. It is desirable for the connector to have the strength and reliability of a threaded connection, but without the use of a threaded fastener which requires many rotations to secure it on the port, and which may require a tool such as a wrench, to perform a final tightening of the fastener.

There is a further need for a single gripping connector that can accommodate a range of port sizes, such that it is connectable and therefore reverse-compatible with a variety of existing audio-visual products that have been sold and are currently in use.

SUMMARY OF THE INVENTION

In a gripping connector, the problem of quickly and tightly connecting to a corresponding port is solved by providing the connector with a means for flexing the fingers of the connector inwardly against the body of the port after the connector is inserted into the port, such that the connector fingers clamp onto the body of the port. In the connector, the means for flexing the connector fingers includes an outer sleeve which is rotatable through a small angular displacement to flex the connector fingers and produce the clamping action on the port. In that manner, the connector may be quickly and firmly connected to the port, and may be easily released from the port, through many repetitions of connection and disconnection.

More specifically, the present invention meets the above described need by providing a gripping connector comprising an electrically conductive central body, an outer sleeve rotatably coupled to the central body, and a tubular cam member disposed between the outer sleeve and the central body. The electrically conductive central body is comprised of a forward end, a rearward end, an outer cylindrical wall, and a plurality of fingers originating around the circumference of the outer cylindrical wall and extending forwardly from the forward end of the body. An axial bore is made through the body. The outer sleeve is rotatable around the central axis of the central body from a first rotational position to a second rotational position, and is comprised of a forward end, a rearward end, and an inner bore including a forward region comprising a first axial cam structure. The tubular cam member is comprised of a forward end, a rearward end, and a cylindrical outer wall comprised of a second axial cam structure engaged with the first axial cam structure of the outer sleeve. An axial through bore is made through the tubular cam member. The through bore is comprised of a cylindrical region proximate to the rearward end of the member, and a radial camming region proximate to the forward end of the member, wherein the radial camming region is in contact with the fingers of the central body. The tubular cam member is movable from a first axial position to a second axial position.

The radial camming region formed in the axial bore of the tubular cam member, the first axial cam structure formed in the forward region of the inner bore of the outer sleeve, and the second axial cam structure formed on the cylindrical outer wall of the tubular cam member cooperate to serve as means for displacing the fingers of the electrically conductive central body radially inwardly to secure the connector to a corresponding port. When the outer sleeve is rotated around the central body from its first rotational position to its second rotational position, the tubular cam member is displaced from its first axial position to its second axial position by the engagement of the first axial cam structure of the cylindrical outer wall with the second axial cam structure of the outer sleeve, thereby causing the radial camming region of the axial through bore of the tubular cam member to displace the fingers of the electrically conductive central body radially inwardly. In that manner, when the connector is plugged into a port or jack comprising a cylindrical body that is at least partially enclosed by the fingers of the central body of the connector, the fingers clamp onto the body of the port, thereby securing the connector to the port. In one embodiment, the radial camming region of the tubular cam member may be formed as a frustoconical region which tapers to a lesser thickness at the forward end of the member. When the tubular cam member is displaced axially in the forward direction, the frustoconical region acts as a wedge to displace the fingers of the conductive central body radially inwardly. In another embodiment, the radial camming region may be provided with a groove or cavities around the inner circumference thereof, and the fingers of the conductive central body may be provided with outwardly protruding ridges or bumps. When the tubular cam member is displaced axially in the forward direction, the protruding ridges/bumps are moved out of the grooves/cavities, thereby displacing the fingers of the conductive central body radially inwardly.

The thread of the cylindrical outer wall of the tubular cam member may be comprised of a first thread block extending over a portion of the circumference of the cylindrical outer wall. The thread of the cylindrical outer wall may be further comprised of a second thread block extending over a second portion of the circumference of the cylindrical outer wall. In such a configuration, the first thread block and the second thread block may be disposed about 180 degrees opposite each other on the circumference of the cylindrical outer wall. In another embodiment, the thread of the cylindrical outer wall of the tubular cam member may be a single thread traversing about 360 degrees of the circumference of the cylindrical outer wall. In another embodiment, the outer sleeve is not provided with threads. Instead, the outer sleeve and tubular cam member are configured to be coupled with a "bayonet connection" between them. Other axial camming arrangements between the outer sleeve and the tubular cam member are contemplated.

The outer cylindrical wall of the conductive central body may include an axial keyway extending forwardly from the rearward end of the body. The cylindrical region of the axial through bore of the tubular cam member may include a corresponding axial key that extends forwardly from the rearward end of the member and is engaged with the axial keyway. The inner bore of the outer sleeve may be further comprised of a central region comprising a shoulder, such that when the tubular cam member is in the first axial position, the rearward end of the member is proximate to the shoulder.

The connector may be further comprised of a central pin and an annular insulator. When the connector is plugged into a corresponding signal port, the central pin is received in the central hole of a port. The central pin may be comprised of a tubular body comprising a forward end, a rearward end, and a flange formed at the rearward end of the tubular body. In such a configuration, the flange of the tubular body is contained within the insulator and the annular insulator is in contact with the forward end of the central body. A cavity may be formed in the forward end of the electrically conductive central body, and the annular insulator of the central pin may be disposed in the cavity. In one embodiment, the flange of the conductive tubular body of the central pin may be embedded within the annular insulator. In another embodiment, the annular insulator may be comprised of an insulating spacer and an insulating retainer, with the conductive tubular body of the central pin disposed between the insulating spacer and the insulating retainer. The central pin is coaxial with the central axis of the central body if the central hole of the port is coaxial with the central axis of the cylindrical body of the port.

The electrically conductive tubular body of the central pin may include a terminal bore formed therein. A contact ferrule comprised of a plurality of inwardly directed fingers may be disposed in the terminal bore. In such a configuration, the contact ferrule receives and retains the central conductor of a coaxial cable that is fitted to the connector. In another embodiment which may be fitted to a coaxial cable having a stranded central conductor, the central pin may be provided without a terminal bore, and instead be provided with a elongated cone or spike extending rearwardly from the rearward end thereof. When the cable is inserted into the connector, the apex of the cone penetrates inwardly among the strands of the central conductor, thereby achieving complete electrical continuity between the central conductor and the central pin.

The connector may be further comprised of an intermediate body joined to the central body and extending rearwardly from the rearward end of the central body. The intermediate body may include a first engagement feature that is engaged with a second engagement feature on the inner bore of the outer sleeve, such that the outer sleeve is rotatable around the intermediate body. The intermediate body and the central body may be formed as a single unitary part, or they may be separate parts. The central body may be further comprised of a tubular extension extending rearwardly from the rear end of the central body and comprising a bonding region, and the intermediate body may be comprised of an axial bore comprising a forward region. In such a configuration, the bonding region of the central body may be joined to the forward region of the axial bore of the intermediate body. The tubular extension of the central body may further include a tube extending rearwardly from the bonding region and terminating at an annular barb. The connector may further include a compression sleeve comprising a central bore configured to receive a prepared coaxial cable therethrough and movable between a free position and an engaged position within the axial bore of the intermediate body. When the compression sleeve is moved to the engaged position, a constriction is formed between the annular barb of the tubular extension of the central body and the central bore of the compression sleeve. In that manner, a coaxial cable that is inserted into the connector is pinched at the constriction, and is thus firmly retained in the connector.

In accordance with the present invention, there is further provided a method for connecting the gripping connector to a signal port comprised of a port body having an end wall and a cylindrical side wall. The method includes inserting the central pin of the connector into the central receptacle of the signal port until the forward end of the electrically conductive central body is proximate to the end wall of the port body, and the cylindrical side wall of the port body is at least partially enclosed by the fingers of the central body. The outer sleeve of the connector is then rotated around the central axis of the central body from the first rotational position to the second rotational position to cause the tubular cam member to move from a first axial position to a second axial position. This causes the radial camming region of the axial through bore of the tubular cam member to displace the fingers of the electrically conductive central body radially inwardly into clamping contact with the cylindrical side wall of the signal port. Additionally, when the outer sleeve is rotated from the first rotational position to the second rotational position, the axial key engaged with the axial keyway prevents rotation of the tubular cam member around the conductive central body while guiding the conductive central body axially from the first axial position to the second axial position.

The connector may be repeatedly removed from and refitted to the port. To accomplish this, the outer sleeve is first rotated from the second rotational position to the first rotational position, and the connector is removed from the signal port. Then the steps of inserting the central pin of the connector into the central receptacle of the signal port, and rotating the outer sleeve around the central axis of the central body from the first rotational position to the second rotational position to cause the fingers to clamp onto the body of the port are repeated.

The foregoing and additional objects, advantages, and characterizing features of the present invention will become increasingly more apparent upon a reading of the following detailed description together with the included drawings.

BRIEF DESCRIPTION OF THE DRAWINGS

The present disclosure is provided with reference to the following drawings, in which like numerals refer to like elements, and in which.

The invention disclosed herein will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION OF THE PREFERRED EMBODIMENTS

In the following disclosure of the instant gripping connector, certain components may be identified with the adjectives "forward," "rearward," "top," "bottom," "upper," "lower," "left," "right," etc. These adjectives are provided with respect to the structure and method of use of the connector in the context of the orientation of the drawings, which is arbitrary. The description is not to be construed as limiting the connector to use in a particular spatial orientation. The instant connector may be used in orientations other than those shown and described herein.

Figure 1:
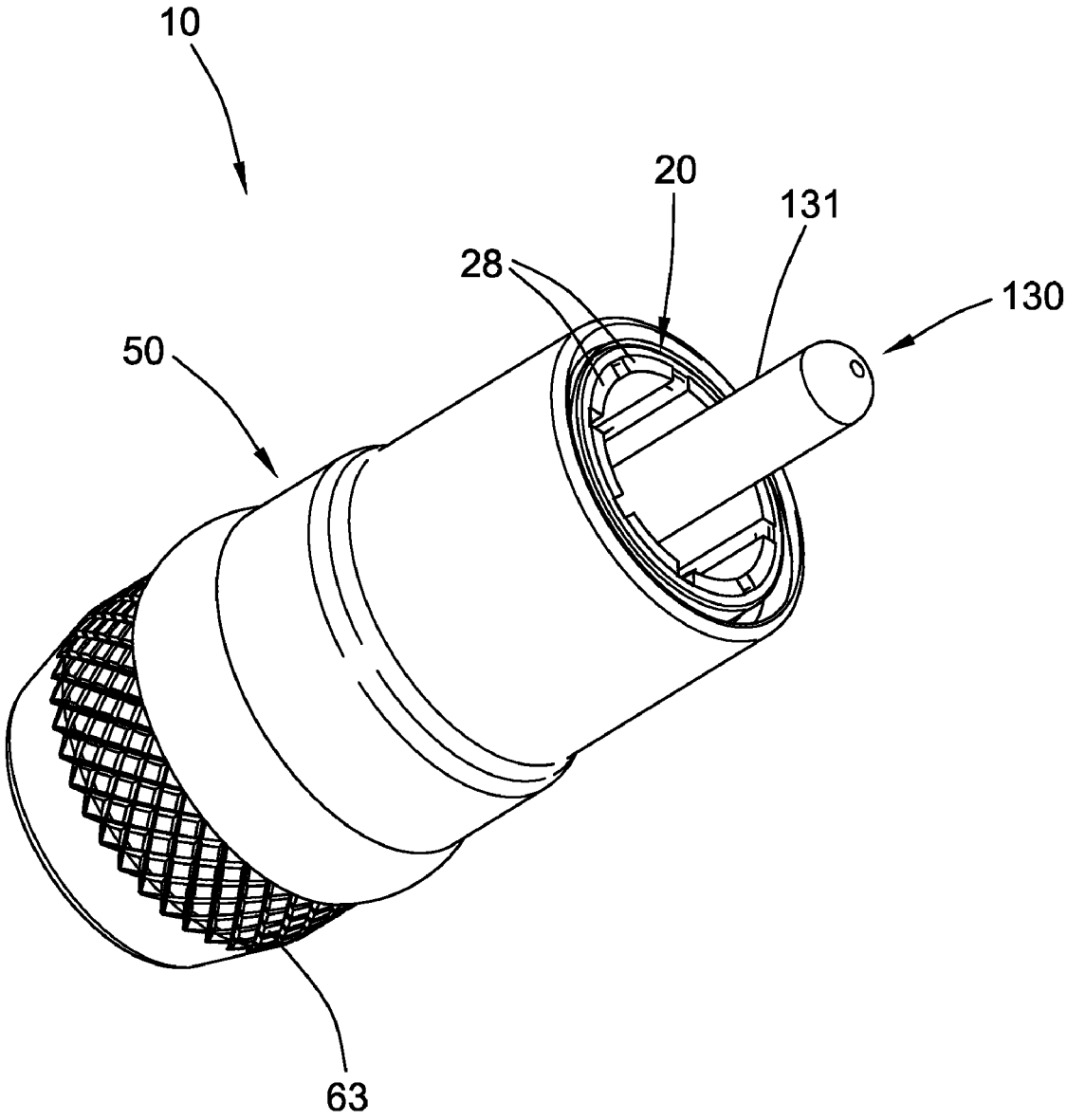
FIG. 1 is a perspective view of one embodiment of the gripping connector of the present invention.
Figure 2:
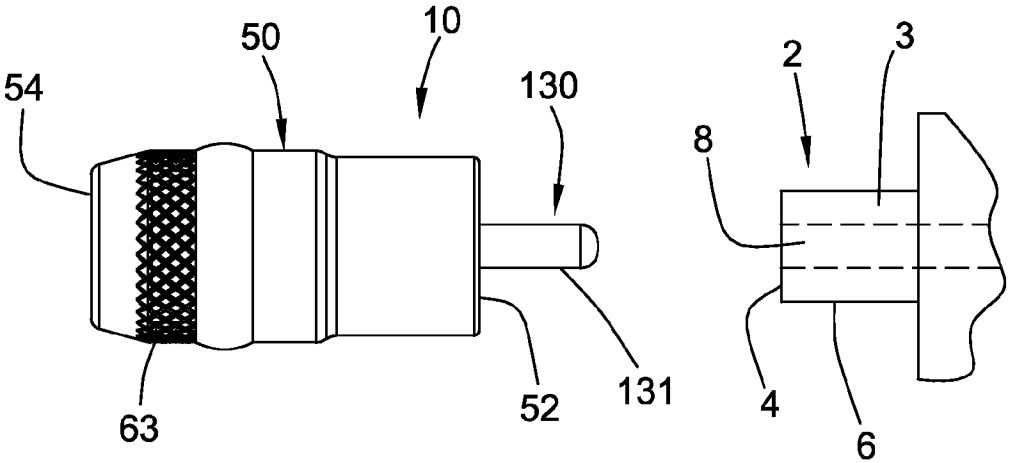
FIG. 2 is a side elevation view of the connector of FIG. 1, and a port to which the connector may be connected.

Referring first to FIG. 2, the connector 10 is connectable to a signal port 2 such as an RCA port, which is comprised of a port body 3 having an end wall 4 and a cylindrical side wall 6. A central hole 8 is provided in the port body 3 for receiving a central pin 130 of the connector 10. Referring also to FIGS. 1, 3, 4A, and 4B, the connector 10 is comprised of an electrically conductive central body 20, an outer sleeve 50 rotatably coupled to the central body 20, and a tubular cam member 70 disposed between the outer sleeve 50 and the central body 20. The electrically conductive central body 20 is comprised of a forward end 22, a rearward end 24, an outer cylindrical wall 26, and a plurality of fingers 28 originating around the circumference of the outer cylindrical wall 26 and extending forwardly from the forward end 22 of the body 20. An axial bore 30 is made through the body.

The outer sleeve 50 is rotatable around the central axis 32 of the central body 20 from a first rotational position to a second rotational position. The outer sleeve 50 is comprised of a forward end 52, a rearward end 54, and an inner bore 56 including a forward region comprising a first axial cam structure, which may comprise threads 58. The threads 58 may be formed as a single helical groove formed around the forward region of the inner bore 56, or the threads 58 may comprise more than one helical groove in sequence.

The tubular cam member 70 is comprised of a forward end 72, a rearward end 74, and a cylindrical outer wall 76 comprised of a second axial cam structure 78 engaged with the first axial cam structure of the outer sleeve 50. In the embodiment depicted in FIGS. 4A-6, the second axial cam structure 78 may be a thread. The thread may be comprised of a first thread block 80 extending over a portion of the circumference of the cylindrical outer wall 76. The thread of the cylindrical outer wall may be further comprised of a second thread block 82 extending over a second portion of the circumference of the cylindrical outer wall 76. In such a configuration, the first thread block 80 and the second thread block 82 may be disposed about 180 degrees opposite each other on the circumference of the cylindrical outer wall 76. The thread blocks 80 and 82 are not directly opposite each other, but instead are offset axially according to the pitch of the threads 58 of the outer sleeve 50, so as to engage with such threads 58. In another embodiment (not shown), the thread of the tubular cam member 70 may be a single thread traversing about 360 degrees of the circumference of the cylindrical outer wall 76. In another embodiment (not shown), the tubular cam member 70 may be provided with threads along part or all of its cylindrical outer wall 76, and the outer sleeve 50 may be provided with corresponding thread blocks protruding inwardly from the inner bore 56 thereof, and engaged with the threads of the tubular cam member. In other words, the thread-and-thread block configuration of the two parts 50 and 70 may be reversed.

Figure 8:
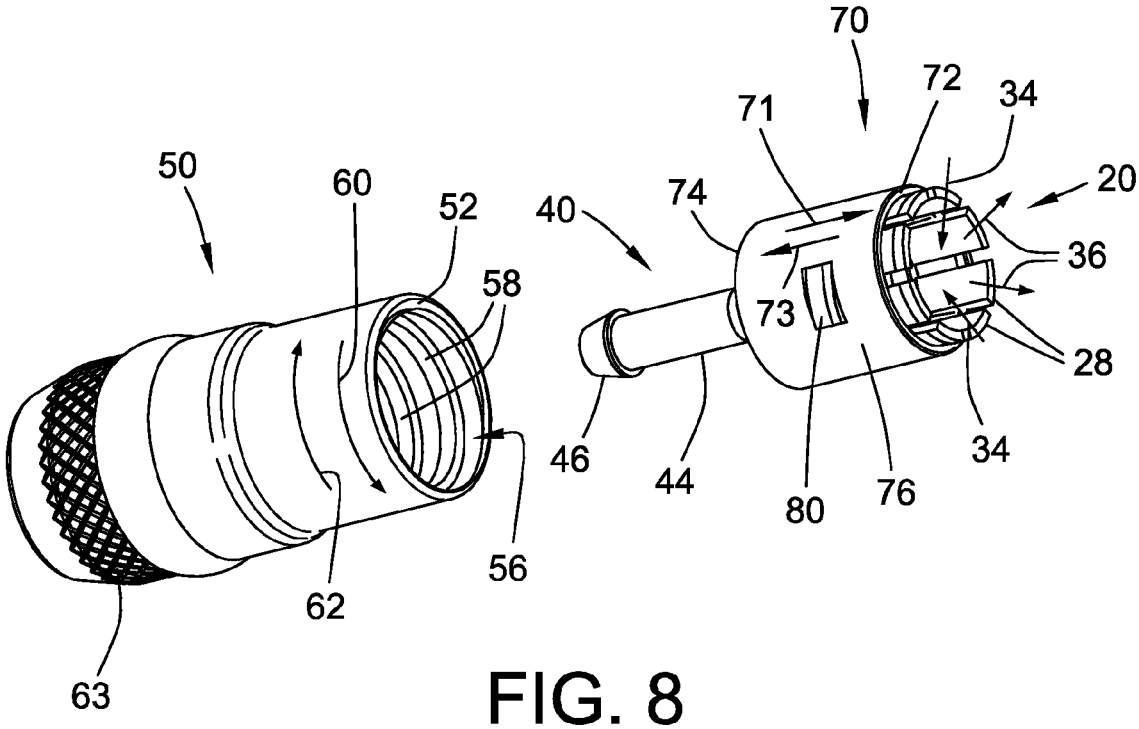
FIG. 8 is a perspective view of the central body and the tubular cam member of the connector shown separated from an outer sleeve which contains them, and which is rotatable around the tubular cam member to displace the fingers of the connector radially inwardly.

In an alternative embodiment (not shown), the first axial cam structure of the outer sleeve 50 and the second axial cam structure of the tubular cam member 70 are configured to be provide a "bayonet connection" between the two parts 50 and 70. Such bayonet connections are known, and are used in certain audio-visual cable connectors (such as BNC connectors) and in electrical lamp-and-socket connections such as B22d (for compact fluorescent bulbs) and GU10 (for certain LED lamps). In the bayonet connection configuration, the outer sleeve 50 may be provided with a smooth inner bore 56, and an L-shaped slot or groove formed on the inner bore 56. The axially oriented portion of the L-shaped groove extends rearwardly from the forward end 52 of the outer sleeve 50. The circumferentially oriented portion of the L-shaped groove extends around the inner bore 56 of the outer sleeve 50, and is at an acute angle with respect to the axially oriented portion, so as to provide a "pitch" similar to the pitch of the threads 58. (See FIGS. 4A and 8). The circumferentially oriented portion of the L-shaped groove acts as the first axial cam structure. The outer sleeve 50 is preferably provided with two L-shaped grooves disposed substantially 180 degrees opposite each other.

The tubular cam member 70 is provided with a pin or protuberance extending outwardly from the cylindrical outer wall 76 thereof, and preferably two such protuberances disposed substantially 180 degrees opposite each other. The pin(s) or protuberance(s) act as the second axial cam structure. When the connector 10 is assembled, the L-shaped groove or grooves of the outer sleeve 50 receive the protuberance or protuberances of the tubular cam member 70. The protuberances are fully inserted axially into their respective grooves, and then the outer sleeve 50 is rotated with respect to the tubular cam member 70, so that the protuberances are disposed within the circumferentially oriented portions of the L-shaped grooves. From that point, any rotation of the outer sleeve 50 with respect to the tubular cam member 70 produces the desired axial camming motion of the tubular cam member 70 with respect to the outer sleeve 50. It will be apparent that the groove and protuberance configuration between the tubular cam member 70 and the outer sleeve 50 could be reversed to achieve the same result, as was described previously for the threaded configuration.

Other sleeve-and-cam member configurations are contemplated, with the operative requirement being that the two parts 50 and 70 have an axial camming arrangement between them. One of the outer sleeve 50 and the tubular cam member 70 is provided with a first axial cam structure, and the other of the two members 50 and 70 is provided with a second axial cam structure that engages with the first axial cam structure of the other member, so that when the outer sleeve 50 is rotated with respect to the tubular cam member 70, an axial camming action occurs between the two parts 50 and 70, thereby displacing the tubular cam member 70 axially with respect to the outer sleeve 50 and the central body 20.

An axial through bore 84 is made through the tubular cam member 70. The through bore 84 is comprised of a cylindrical region 86 proximate to the rearward end 74 of the cam member 70, and a radial camming region 88 proximate to the forward end 72 of the cam member 70. The radial camming region 88 is in contact with the fingers 28 of the central body 20.

Figure 6:
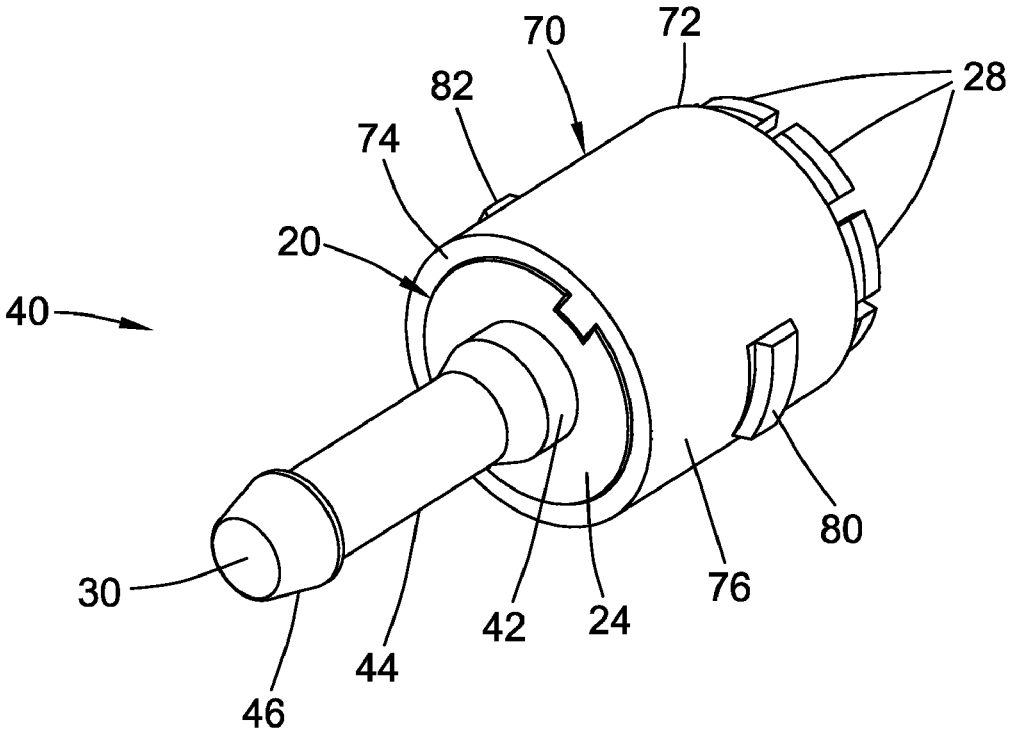
FIG. 6 is a second perspective view of the central body and the tubular cam member of the connector.
Figure 7:
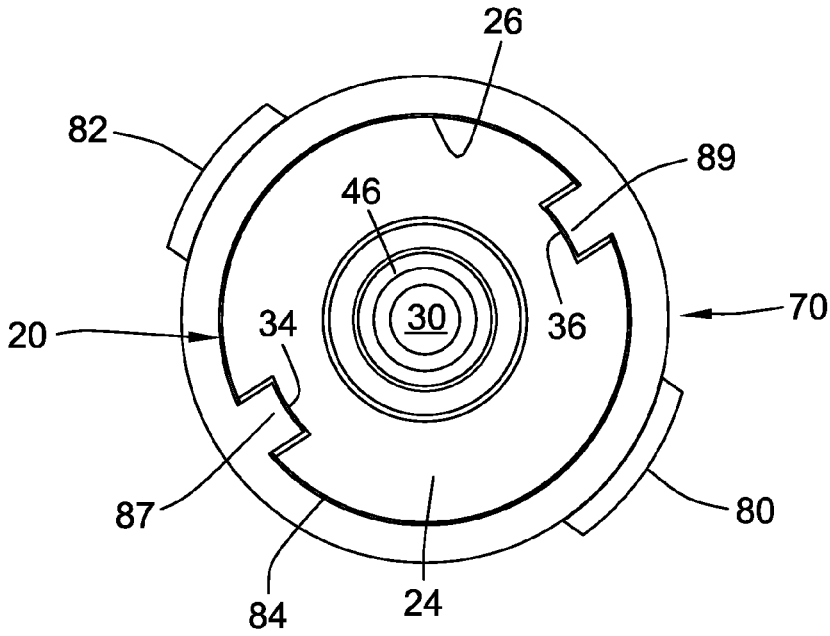
FIG. 7 is an end view of the central body and the tubular cam member of the connector.

The outer cylindrical wall 26 of the conductive central body 20 may include an axial keyway extending forwardly from the rearward end 24 of the body 20. The cylindrical region 36 of the axial through bore 84 of the tubular cam member 70 may include a corresponding axial key that extends forwardly from the rearward end 74 of the member 70 and is engaged with the axial keyway. Referring also to FIGS. 6 and 7, and in the embodiment depicted therein, the conductive central body 20 is comprised of first and second axial keyways 34 and 36 extending forwardly from the rearward end 24 of the body 20. The tubular cam member 70 is comprised of corresponding axial keys 87 and 89, which are engaged with the respective axial keyways 34 and 36. The combination of an axial keyway engaged in an axial key serves as means for preventing rotational motion of the tubular cam member 70 with respect to the central body 20 and the outer sleeve 50, while allowing and guiding axial motion of the tubular cam member 70 with respect to the central body 20 and the outer sleeve 50. It will be apparent that the arrangement of the axial keyway and the axial key could be reversed while achieving the same result, i.e., the axial keyway could be formed in the inner wall 84 of the tubular cam member 70, and the axial key could be formed on the outer cylindrical wall 26 of the central body 20.

In other embodiments, the central body 20 and tubular cam member 70 may be provided with more than two matched keys and keyways. The cylindrical region 36 of the axial through bore 84 of the tubular cam member 70 may be provided with a continuum of axial keys and keyways and the conductive central body 20 may be provided with a corresponding continuum of axial keys and keyways. In other words, the central body 20 and tubular cam member 70 may be configured to have a matched splined shaft-and-socket configuration. Other means for preventing rotational motion while allowing axial motion of the tubular cam member 70 with respect to the central body 20 may be provided.

The radial camming region 88 formed in the axial bore 84 of the tubular cam member 70, the threads 58 formed in a forward region of the inner bore 56 of the outer sleeve 50, and the thread 78, or thread blocks 80 and 82 formed in the cylindrical outer wall 76 of the tubular cam member 70, cooperate to serve as means for displacing the fingers 28 of the electrically conductive central body 20 radially inwardly to secure the connector 10 to a corresponding port. In one embodiment, the radial camming region 88 of the tubular cam member 70 may be formed as a frustoconical region 88 which tapers to a lesser thickness at the forward end 72 of the member 70. This is best understood with reference in particular to FIGS. 4A, 4B, 5, and 8. Noting that the assembled tubular cam member 70 and central body 20 are shown exploded from the outer sleeve 50 in FIG. 8, when the outer sleeve 50 is rotated around the central body 20 from its first rotational position to its second rotational position as indicated by arrow 60, the tubular cam member 70 is displaced axially as indicated by arrow 71 from its first axial position shown in FIG. 4A to its second axial position shown in FIG. 4B. This axial motion occurs due to the engagement of the thread 78 or thread blocks 80 and 82 of the cam member 70 with the threads 58 of the outer sleeve 50, or the alternative axial camming arrangement of a bayonet connector also described herein. This axial motion causes the frustoconical region 88 of the axial through bore 84 of the cam member 70 to act as a wedge, displacing the fingers 28 of the central body radially inwardly as indicated by arrows 34. It can be seen particularly in FIG. 4B that when the connector 10 is plugged into a port 2 comprising a cylindrical body 3 that is at least partially enclosed by the fingers 28 of the central body 20, the fingers 28 of the connector 10 clamp onto the body 3 of the port 2, thereby securing the connector 10 to the port 2.

Figure 4A:
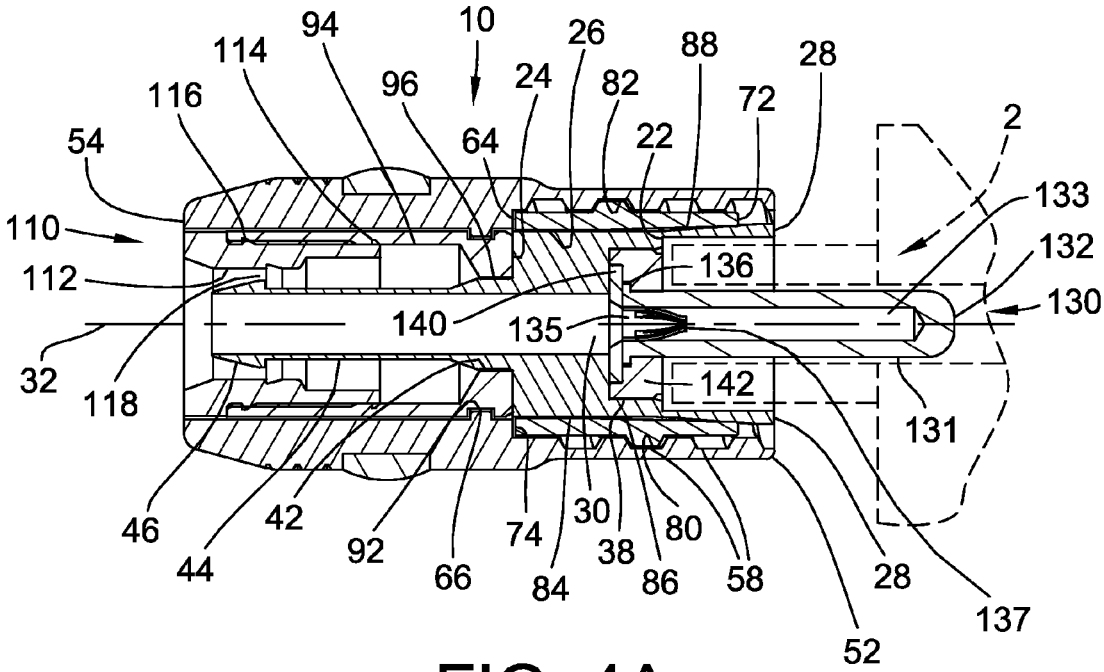
FIG. 4A is a cross-sectional view of the connector, depicting the fingers thereof in a relaxed and radially outward position.
Figure 4B:
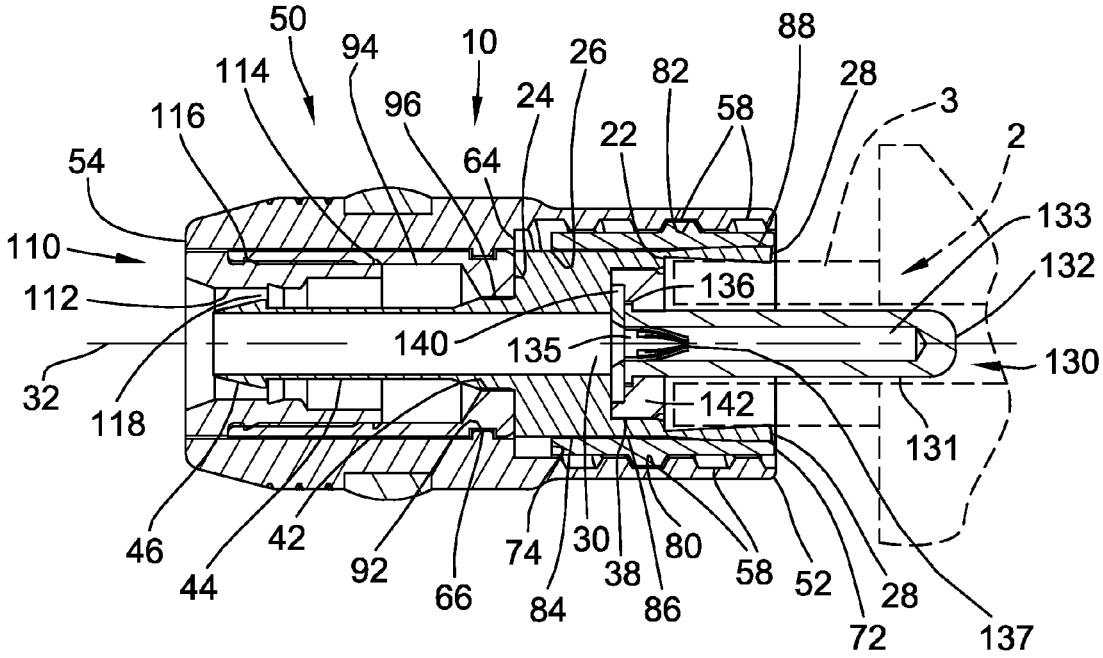
FIG. 4B is a cross-sectional view of the connector, depicting the fingers thereof in a radially inwardly displaced position for clamping onto the body of a port.
Figure 5:
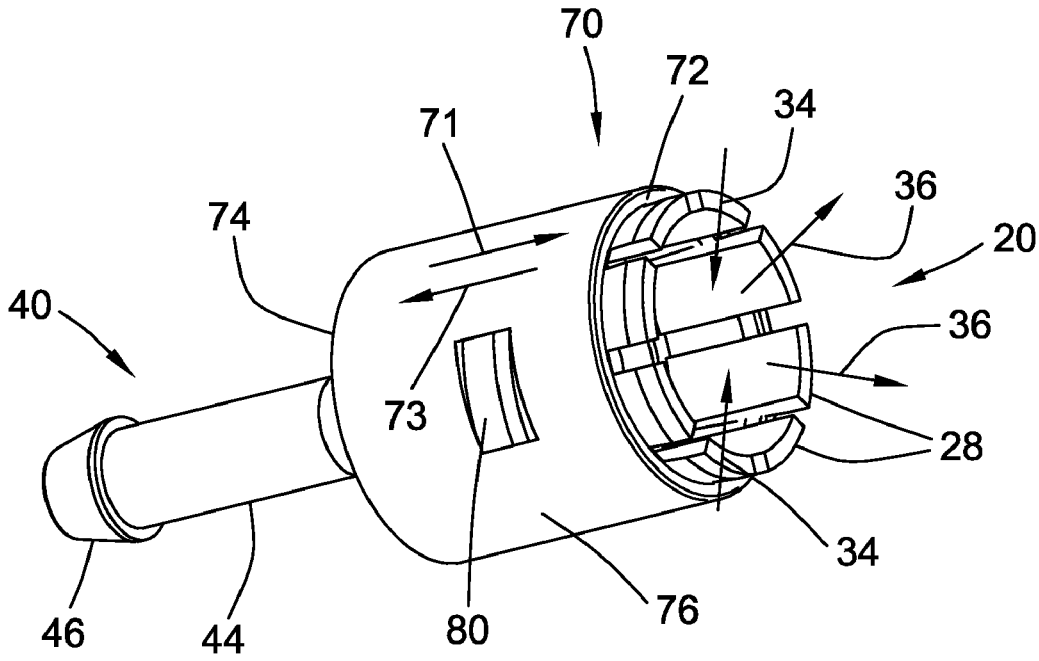
FIG. 5 is a first perspective view of a central body and a tubular cam member of the connector, which in combination act as means to displace the fingers of the connector radially inwardly to clamp onto the body of a port.

In another embodiment (not shown) the radial camming region 88 of the tubular cam member 70 may be provided with a groove or a series of cavities around the inner circumference thereof, and the fingers 28 of the conductive central body 20 may be provided with outwardly protruding ridges or bumps, such that when the conductive central body 20 is in the retracted position as shown in FIG. 4A, the outwardly protruding ridges/bumps are disposed in the groove/cavities. Then when the conductive central body 20 is moved to the forward position as shown in FIG. 4B, the outwardly protruding ridges/bumps are disengaged with the groove/cavities of the tubular cam member 70, thereby providing a radial camming action to displace the fingers 28 of the electrically conductive central body 20 radially inwardly. It will be apparent that the arrangement of the grooves or cavities and the outwardly protruding ridges or bumps between the two parts 20 and 70 could be reversed to achieve the same result.

Other radial camming configurations are contemplated, with the operative requirement being that the two parts 20 and 70 have an radial camming arrangement between the radial camming region 88 of the tubular cam member 70 and the fingers 28 of the conductive central body 20. In that manner, when the tubular cam member 70 is displaced axially with respect to the conductive central body 20, a radial camming action occurs between the tubular cam member 70 and the conductive central body fingers 28, thereby displacing the fingers 28 radially inwardly.

The relative amount of rotation of the outer sleeve 50 that is required to secure the connector 10 to the port 2 will depend upon the pitch of the threads 58 of the outer sleeve 50, the inner diameter of the cylinder formed by the fingers 28 in their expanded state, and the diameter of the body 3 of the port 2, i.e., the relative difference between the two diameters, and how much the fingers 28 must be displaced inwardly to apply clamping force on the port body 3. When there is already contact between the fingers 28 and the port body 3, as little as about 30 degrees of rotation of the outer sleeve may be sufficient to securely clamp the fingers 28 onto the port body 3. One aspect of the instant connector 10 is that it can accommodate a substantial relative variation in port sizes, whether due to variation in manufacturing tolerances, or ports of different electrical standards. The instant connector is thus reverse-compatible with a variety of existing audio-visual products that have been sold and are currently in use. A rotation of less than about one turn is sufficient to secure the connector 10 to most RCA ports, which renders the connector 10 easy to secure to a port in almost all circumstances. The outer sleeve 50 may be further provided with knurling 63 or some other feature to provide a better grip for the user of the connector 10 when performing the rotational motion.

The connector 10 may be repeatedly removed from and refitted to the port 2. To accomplish this, the outer sleeve 50 is first rotated from its second rotational position to its first rotational position as indicated by arrow 62, which causes the reverse axial motion of the tubular cam member 70 as indicated by arrow 73. The fingers 28 of the central body 20 relax outwardly as indicated by arrows 36 to their positions of FIG. 4A, thereby ceasing the clamping of the port 2. The connector 10 is then removed from the port 2. Then the steps of placing the connector 10 onto the signal port 2, and rotating the outer sleeve 50 from the first rotational position to the second rotational position to cause the fingers 28 to clamp onto the port body 3 may then be repeated. Referring again to FIGS. 4A and 4B, in order to provide a repeatable location of the first rotational position of the outer sleeve 50 and axial position of the tubular cam member 70, the inner bore 56 of the outer sleeve 50 may further include a shoulder 64 in the central region thereof, such that when the tubular cam member 70 is in the first axial position, the rearward end 74 of the member 70 is proximate to, or in contact with the shoulder 64. The shoulder 64 acts as a locator for the first rotational position of the outer sleeve 50 and first axial position of the tubular cam member 70, and as a stop of the tubular cam member 70 when rotating the outer sleeve 50 from its second rotational position to its first rotational position.

Figure 3:
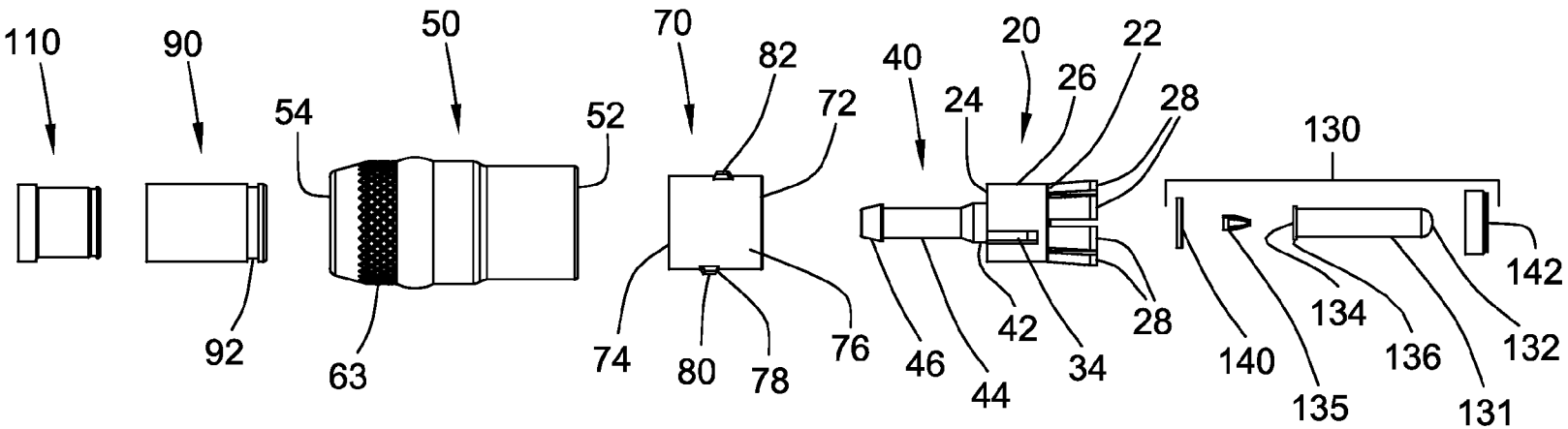
FIG. 3 is an exploded side elevation view of the connector of FIG. 1.

The connector may be further comprised of a central pin and an annular insulator. When the connector is plugged into a corresponding signal port, the central pin is received in the central hole of a port. The central pin may be of any shape that matches the corresponding shape of the central hole of the port. Most commonly, the central pin and central hole are cylindrical, and are coaxial with the respective central axes of the connector and port. Referring to FIGS. 3, 4A, and 4B, the central pin 130 may be comprised of a tubular body 131 comprising a forward end 132, a rearward end 134, and a flange 136 formed at the rearward end of the tubular body 131. In such a configuration, the flange 131 of the tubular body is contained within the insulator and the annular insulator is in contact with the forward end 22 of the central body 20. In one embodiment (not shown), the flange 136 of the conductive tubular body 131 of the central pin 130 may be embedded within the annular insulator. For example, the annular insulator may be made of plastic or ceramic that is molded around the flange 136 of the tubular body 131.

In another embodiment depicted in FIGS. 3, 4A, and 4B, the annular insulator is comprised of an insulating spacer 140 and an insulating retainer 142, with the conductive tubular body 131 of the central pin 130 disposed between the insulating spacer 140 and the insulating retainer 142. The central pin 130 is made coaxial with the central axis 32 of the central body 20 if the central hole 8 of the port 2 is coaxial with the central axis of the cylindrical port body 3. The electrically conductive tubular body 131 of the central pin 130 may include a terminal bore 133 formed therein. A contact ferrule 135 comprised of a plurality of inwardly directed fingers 137 may be disposed in the terminal bore 133. The contact ferrule 135 may be joined to the terminal bore 133 of the tubular body by a press fit, by adhesive, or by other suitable means. In such a configuration, the contact ferrule 135 receives and retains the central conductor of a coaxial cable (not shown) that is fitted to the connector. In that manner, electrical continuity is provided from the central conductor of the cable to the conductive tubular body 131 of the central pin 130, and on to the conductor (not shown) contained in the central hole 8 of the port 2, when the connector 10 is connected to the port 2. The outer shielding (grounding) of the cable is in contact with the central conductive body 20, which is in contact at fingers 28 thereof with a conductive ring formed as the side wall 6 of the port 2.

Figure 9:
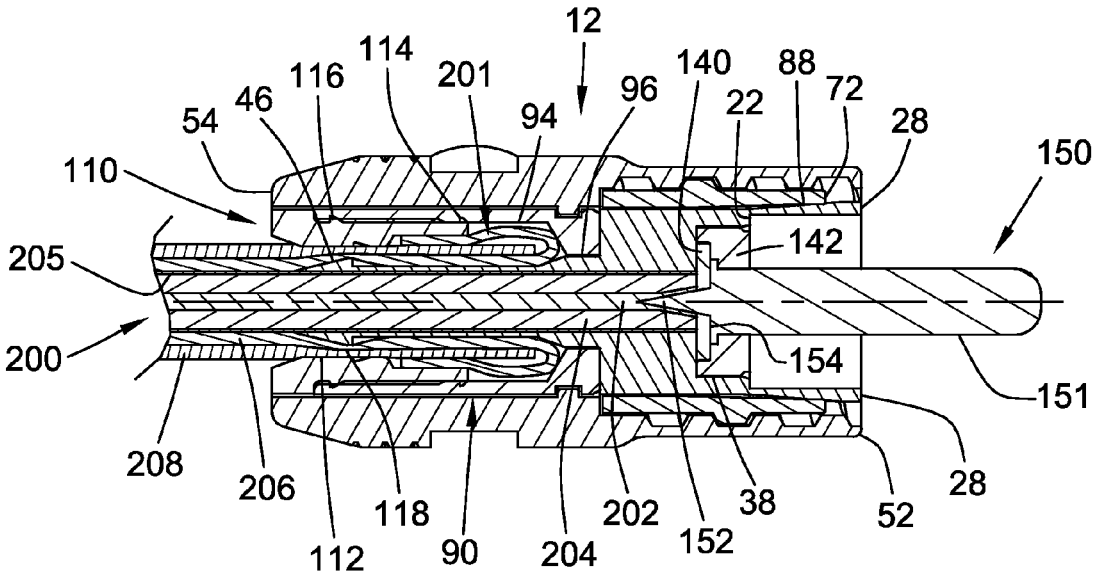
FIG. 9 is a cross-sectional view of an another embodiment of the instant connector, comprising a central conductive pin having a rearwardly extending spike for contacting the central conductor of a coaxial cable.

An alternative embodiment of the connector is provided, which may be fitted to a coaxial cable having a central conductor of stranded wire, or of a soft deformable material. Referring to FIG. 9, the central pin 150 of connector 12 may be provided without a terminal bore in the pin body 151, and instead be provided with an elongated cone or spike 152 extending rearwardly from the rearward end 154 thereof. When a coaxial cable 200 is inserted into the connector 12, the apex of the spike 152 penetrates inwardly among the strands of the central conductor 202, thereby achieving complete electrical continuity between the central conductor 202 and the central pin 150.

The annular insulator prevents electrical contact between the central conductive body 20 and the conductive tubular body 131 of the central pin 130, thereby preventing loss of the electrical signal transmitted from the connector 10 to the port 2. A cavity 38 may be formed in the forward end 22 of the electrically conductive central body 20 for receiving the insulating retainer 142 and insulating spacer 140 of the annular insulator of the central pin 130. The insulating retainer 142 may be joined to the wall of the cavity 38 by a press fit or by adhesive, so as to join the entire assembly of the central pin 130 to the central body 20.

The connector 10 may be further comprised of an intermediate body 90 joined to the conductive central body 20 and extending rearwardly from the rearward end 24 of the central body 20. The intermediate body 90 may include a first engagement feature 92 that is engaged with a corresponding engagement feature 66 on the inner bore 56 of the outer sleeve 50, such that the outer sleeve 50 is rotatable around the intermediate body 90. In the embodiment depicted in FIGS. 3, 4A, and 4B, the engagement feature 92 of the intermediate body 90 is formed as an annular groove having a rectangular cross section, and the corresponding engagement feature 66 of the outer sleeve is formed as an annular protrusion having a slightly smaller rectangular cross section to permit the rotational motion of the outer sleeve 50 around the intermediate body 90. It will be apparent that the arrangement of the engagement features 92 and 66 could be reversed, i.e., the intermediate body 90 could have a protrusion, and the outer sleeve 50 could be grooved. Additionally, engagement feature having shapes other than rectangular could be used.

In one embodiment (not shown), the intermediate body 90 and the central body 20 may be formed as a single unitary part. In the embodiment depicted in FIGS. 3-4B, they are formed as separate parts. In this embodiment, the central body 20 is further comprised of a tubular extension 40 extending rearwardly from the rearward end 24 of the central body 20 and comprising a bonding region 42. The intermediate body 90 is comprised of an axial bore 94 comprising a forward region 96. In such a configuration, the bonding region 42 of the central body 20 is joined to the forward region 96 of the axial bore 94 of the intermediate body 90 by suitable means such as a press fit, or by adhesive.

The tubular extension 40 of the central body 20 may further include a tube 44 extending rearwardly from the bonding region 42 and terminating at an annular barb 46. The connector 10 may further include a compression sleeve 110 comprising a central bore 112 configured to receive a prepared coaxial cable therethrough and movable between a free position and an engaged position within the axial bore 94 of the intermediate body 90. The compression sleeve 110 may be further comprised of first and second engagement features 114 and 116, which engage with corresponding features in the axial bore 94 of the intermediate body 90. Referring also to FIG. 9, a coaxial cable to be secured in the connector 10 may be comprised of a central conductor 202, an annular dielectric 204, an outer conductor 206 that may be of braided wire and may include a foil 205, and an outer protective jacket 208. When a prepared end 201 of the cable 200 is inserted into the connector, and the compression sleeve 110 is compressed forwardly into the intermediate body 90, the outer conductor 206 and the protective jacket 208 are pinched in a constriction 118 that is formed between the barb 46 of the conductive central body 30 and the compression sleeve 110, thereby securing the cable 200 in the connector.

Figure 10:
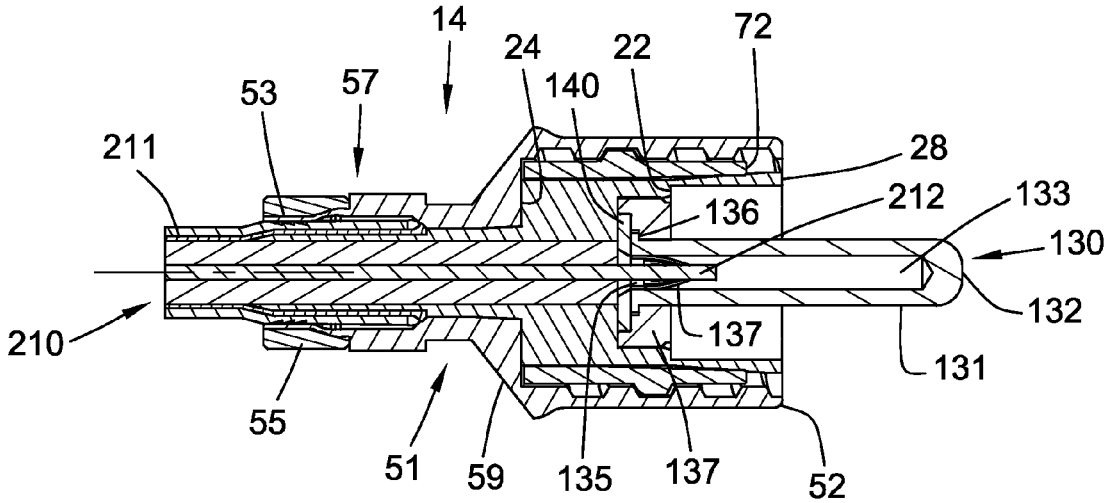
FIG. 10 is a cross-sectional view of an another embodiment of the instant connector, comprising an alternative means for connecting to a coaxial cable.

FIG. 10 is a cross-sectional view of an another embodiment of the instant connector, comprising an alternative means for connecting to a coaxial cable. The connector 10 is comprised of an outer sleeve 51, which includes a rearward end 53 that receives a barbed compression cap 55 engaged with the outer jacket 211 of a coaxial cable 210. The cable connection portion 57 of the outer sleeve 51 may be smaller in diameter than the forward end, with the outer sleeve 51 further comprising a taper 59 between them. Further details of this compression type of cable connection may be found in commonly owned U.S. Pat. No. 6,558,194, the disclosure of which is incorporated herein by reference. Numerous configurations for securing a cable into the connector may be used, such as, but not limited to compression-type connectors, crimp connectors, and sealing connectors. For example, one may use any of the compression-type configurations disclosed in commonly owned U.S. Pat. No. 7,452,237, and commonly owned copending U.S. patent application Ser. No. 12/420,065, the disclosures of which are incorporated herein by reference.

It is, therefore, apparent that there has been provided, in accordance with the present invention, a cable connector for connecting an electrical signal cable to an electrical signal port, and methods for connecting the cable to the port. Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

What is claimed is:

1. A cable connector for connecting an electrical signal cable to an electrical signal port, the connector comprising:

an electrically conductive central body having a central axis and comprised of:

a forward end;

a rearward end;

an outer cylindrical wall;

an axial bore through the central body; and a plurality of fingers extending forwardly from the forward end of the central body;

an outer sleeve rotatably coupled to the central body, rotatable around the central axis of the central body from a first rotational position to a second rotational position, and comprised of a forward end, a rearward end, and an inner bore including a forward region comprising a first axial cam structure; and a tubular cam member disposed between the outer sleeve and the central body, movable from a first axial position to a second axial position, and comprising:

a forward end;

a rearward end;

a cylindrical outer wall comprised of a second axial cam structure engaged with the first axial cam structure of the outer sleeve;

an axial through bore comprised of a cylindrical region proximate to the rearward end of the cam member, and a radial camming region proximate to the forward end of the cam member, wherein the radial camming region is in contact with the fingers of the central body;

wherein when the outer sleeve is rotated around the central body from its first rotational position to its second rotational position, the tubular cam member is displaced from its first axial position to its second axial position by the engagement of the first axial cam structure of the cylindrical outer wall with the second axial cam structure of the outer sleeve, thereby causing the radial camming region of the axial through bore of the tubular cam member to displace the fingers of the electrically conductive central body radially inwardly;

wherein the first axial cam structure of the central body is comprised of threads, and the second axial cam structure of the cylindrical outer wall of the tubular cam member is comprised of a first thread block extending over a portion of a circumference of the cylindrical outer wall.

2. The connector of claim 1, wherein the first axial cam structure of the outer sleeve is comprised of threads, and the second axial cam structure of the cylindrical outer wall of the tubular cam member is a single thread traversing about 360 degrees of the circumference of the cylindrical outer wall.

3. The connector of claim 1, wherein the outer cylindrical wall of the conductive central body is comprised of an axial keyway extending forwardly from the rearward end of the body, and the cylindrical region of the axial through bore of the tubular cam member is comprised of an axial key that extends forwardly from the rearward end of the member and is engaged with the axial keyway.

4. The connector of claim 1, wherein the inner bore of the outer sleeve is further comprised of a central region comprising a shoulder, and wherein the rearward end of the tubular cam member in the first axial position is proximate to the shoulder.

5. The connector of claim 1, wherein the radial camming region of the tubular cam member is comprised of a frustoconical surface in contact with the fingers of the electrically conductive central body.

6. The connector of claim 1, wherein the first axial cam structure of the central body is comprised of threads, and the second axial cam structure of the cylindrical outer wall of the tubular cam member is comprised of a first thread block extending over a first portion of the circumference of the cylindrical outer wall, and a second thread block extending over a second portion of the circumference of the cylindrical outer wall.

7. The connector of claim 6, wherein the first thread block and the second thread block are about 180 degrees opposite each other on the circumference of the cylindrical outer wall.

8. The connector of claim 1, further comprising an intermediate body joined to the central body and extending rearwardly from the rearward end of the central body, the intermediate body comprising a first engagement feature that is engaged with a second engagement feature on the inner bore of the outer sleeve, wherein the outer sleeve is rotatable around the intermediate body.

9. The connector of claim 8, wherein the intermediate body and the central body are formed as a single unitary part.

10. The connector of claim 8, wherein the central body is further comprised of a tubular extension extending rearwardly from the rear end of the central body and comprising a bonding region; wherein the intermediate body is comprised of an axial bore comprising a forward region; and wherein the bonding region of the central body is joined to the forward region of the axial bore of the intermediate body.

11. The connector of claim 10, wherein the tubular extension of the central body is further comprised of a tube extending rearwardly from the bonding region and terminating at an annular barb.

12. The connector of claim 11, further comprising a compression sleeve comprising a central bore configured to receive a prepared coaxial cable therethrough, and movable between a free position and an engaged position within the axial bore of the intermediate body, wherein when the compression sleeve is moved to the engaged position, a constriction is formed between the annular barb of the tubular extension of the central body and the central bore of the compression sleeve.

13. The connector of claim 1, further comprising a central pin comprised of:

an electrically conductive body comprised of a forward end, a rearward end, and a flange formed at the rearward end of a tubular body; and an annular insulator, wherein the flange of the tubular body is contained within the annular insulator and the annular insulator is in contact with the forward end of the central body.

14. The connector of claim 13, wherein the flange of the conductive body of the central pin is embedded within the annular insulator.

15. The connector of claim 13, wherein the annular insulator of the central pin is comprised of an insulating spacer and an insulating retainer, and wherein the conductive body of the central pin is disposed between the insulating spacer and the insulating retainer.

16. The connector of claim 13, wherein a cavity is formed in the forward end of the electrically conductive central body, and wherein the annular insulator of the central pin is disposed in the cavity.

17. The connector of claim 13, wherein the electrically conductive body is comprised of a terminal bore therein, and wherein a contact ferrule comprised of a plurality of inwardly directed fingers is disposed in the terminal bore.

18. The connector of claim 13, wherein the central pin is coaxial with the central axis of the central body.

19. The connector of claim 13, wherein the electrically conductive body of the central pin is further comprised of a spike extending from the rearward end of the electrically conductive body.

20. A cable connector for connecting an electrical signal cable to an electrical signal port, the connector comprising:

an electrically conductive central body having a central axis and comprised of a forward end, a rearward end, an outer cylindrical wall, an axial bore through the body, and a plurality of fingers extending forwardly from the forward end of the body;

an outer sleeve rotatably coupled to the central body, rotatable around the central axis of the central body, and comprised of a forward end, a rearward end, and an inner bore;

a tubular cam member disposed between the outer sleeve and the central body and comprising a forward end, a rearward end, a cylindrical outer wall, an axial through bore comprised of a cylindrical region proximate to the rearward end of the member; and means for displacing the fingers of the electrically conductive central body radially inwardly, wherein the means include displacing the tubular cam member in a direction towards the electrical signal port.

21. The connector of claim 20, wherein the means for displacing the fingers of the electrically conductive central body radially inwardly is comprised of:

a radial camming region formed in the axial bore of the tubular cam member proximate to the forward end thereof, the radial camming region in contact with the fingers of the central body;

a first axial cam structure formed in a forward region of the inner bore of the outer sleeve; and a second axial cam structure formed in the cylindrical outer wall of the tubular cam member and engaged with the first axial cam structure of the outer sleeve; wherein when the outer sleeve is rotated around the central body from a first rotational position to a second rotational position, the second axial cam structure of the tubular cam member is displaced forwardly by the first axial cam structure formed in the forward region of the inner bore of the outer sleeve, thereby displacing the cam member from a first axial position to a second axial position, such that the radial camming region of the axial through bore of the tubular cam member displaces the fingers of the electrically conductive central body radially inwardly.

22. The connector of claim 21, wherein the means for displacing the fingers of the electrically conductive central body radially inwardly is further comprised of an axial keyway formed in the outer cylindrical wall of the central body and extending forwardly from the rearward end of the central body, and an axial key formed in the axial through bore of the tubular cam member and extending forwardly from the rearward end of the member, wherein the axial key of the cam member is engaged with the axial keyway of the central body.

23. The connector of claim 21, wherein the radial camming region of the tubular cam member is comprised of a frustoconical surface in contact with the fingers of the electrically conductive central body.

24. A method for connecting a gripping connector to a signal port, the signal port comprising a port body having an end wall and a cylindrical side wall, and a central receptacle formed in the end wall, the method comprising:

providing the gripping connector comprising:

an electrically conductive central body having a central axis and comprised of a forward end, a rearward end, an outer cylindrical wall, an axial bore through the body, and a plurality of fingers extending forwardly from the forward end of the body;

an outer sleeve rotatably coupled to the central body, disposed in a first rotational position and comprised of a forward end, a rearward end, and an inner bore including a forward region comprising a first axial cam structure; a tubular cam member disposed between the outer sleeve and the central body and comprising a forward end, a rearward end, a cylindrical outer wall comprised of a second axial cam structure engaged with the first axial cam structure of the outer sleeve, and an axial through bore comprised of a cylindrical region proximate to the rearward end of the member and a radial camming region proximate to the forward end of the cam member, wherein the radial camming region is in contact with the fingers of the central body; and a central pin extending forwardly from the central body;

inserting the central pin of the connector into the central receptacle of the signal port until the forward end of the electrically conductive central body is proximate to the end wall of the port body, and the cylindrical side wall of the port body is at least partially enclosed by the fingers of the central body;

rotating the outer sleeve around the central axis of the central body from the first rotational position to a second rotational position to cause the tubular cam member to move in a direction towards the signal port from a first axial position to a second axial position, thereby causing the camming region of the axial through bore of the tubular cam member to displace the fingers of the electrically conductive central body radially inwardly into clamping contact with the cylindrical side wall of the signal port.

25. The method of claim 24 wherein the outer cylindrical wall of the conductive central body is comprised of an axial keyway extending forwardly from the rearward end of the body, and the cylindrical region of the axial through bore of the tubular cam member is comprised of an axial key that extends forwardly from the rearward end of the member and is engaged with the axial keyway, and wherein when the outer sleeve is rotated from the first rotational position to the second rotational position, the axial key engaged with the axial keyway prevents rotation of the tubular cam member around the conductive central body while guiding the conductive central body axially from the first axial position to the second axial position.

26. The method of claim 24, further comprising rotating the outer sleeve from the second rotational position to the first rotational position, removing the connector from the signal port, and then repeating the steps of inserting the central pin of the connector into the central receptacle of the signal port and rotating the outer sleeve around the central axis of the central body from the first rotational position to the second rotational position.

27. A cable connector configured to connect to an electrical signal cable to an electrical signal port, the connector comprising:

an electrically conductive central body having a central axis and comprised of:

a forward end;

a rearward end;

an outer cylindrical wall;

an axial bore through the central body; and a plurality of fingers extending forwardly from the forward end of the central body;

an outer sleeve rotatably coupled to the central body, rotatable around the central axis of the central body from a first rotational position to a second rotational position, and comprised of a forward end, a rearward end, and an inner bore including a forward region comprising a first axial cam structure; and a tubular cam member disposed between the outer sleeve and the central body, movable from a first axial position to a second axial position, and comprising:

a forward end;

a rearward end;

a cylindrical outer wall comprised of a second axial cam structure engaged with the first axial cam structure of the outer sleeve;

an axial through bore comprised of a cylindrical region proximate to the rearward end of the cam member, and a radial camming region proximate to the forward end of the cam member, wherein the radial camming region is in contact with the fingers of the central body;

wherein when the outer sleeve is rotated around the central body from its first rotational position to its second rotational position, the tubular cam member is displaced in a direction towards the electrical signal port from its first axial position to its second axial position by the engagement of the first axial cam structure of the cylindrical outer wall with the second axial cam structure of the outer sleeve, thereby causing the radial camming region of the axial through bore of the tubular cam member to displace the fingers of the electrically conductive central body radially inwardly.

* * * * *